US005402669A

United States Patent [19]

Pla et al.

[11] Patent Number: 5,402,669

[45] Date of Patent: Apr. 4, 1995

[54] SENSOR MATCHING THROUGH SOURCE MODELING AND OUTPUT COMPENSATION

[75] Inventors: Frederic G. Pla, Schenectady; Robert A. Hedeen, Clifton Park, both of N.Y.

[73] Assignee: General Electric Company, Schenectady, N.Y.

[21] Appl. No.: 243,013

[22] Filed: May 16, 1994

[51] Int. Cl.[6] ..... H04R 29/00

[52] U.S. Cl. ..... 73/4 R; 381/58; 367/13

[58] Field of Search ..... 73/1 R, 1 D, 1 DV, 2, 73/4 R; 367/13; 381/56

[56] References Cited

U.S. PATENT DOCUMENTS 5,029,215 7/1991 Miller, III ..... 367/13
5,125,260 6/1992 Hedeen .
5,172,597 12/1992 Hedeen .

OTHER PUBLICATIONS

"Adaptive Signal Processing", Widrow et al., 1985 by Prentice-Hall, Inc., Englewood Cliffs, N.J. pp. 17 and 100.

*Primary Examiner*—Robert Raevis
*Attorney, Agent, or Firm*—Douglas E. Erickson; Paul R. Webb, II

[57] ABSTRACT

A method for matching the second output of a second sensor to the first output of a first sensor wherein a source transducer is driven by a reference analog or digital electrical signal to produce the physical quantity (e.g., acoustic pressure) the sensors (e.g., pressure sensors, such as microphones) can sense. A reference adaptive filter determines filtering coefficients to match the reference electrical signal to the first output of the first sensor and therefore models the source transducer and the first sensor (which typically is an independently-calibrated sensor). Thereafter, a second adaptive filter compensates the second output of the second sensor to match the output from a fixed filter having filtering coefficients identical to those determined by the reference adaptive filter, such output compensation of the second sensor not requiring the presence of the first sensor.

10 Claims, 2 Drawing Sheets

SENSOR MATCHING THROUGH SOURCE MODELING AND OUTPUT COMPENSATION

BACKGROUND OF THE INVENTION

The present invention relates generally to matching sensors, and more particularly to using source modeling and output compensation to accurately match the output of one sensor to the output of another sensor.

Sensors include sensors with analog outputs and sensors with digital outputs. Sensors measure physical quantities and include conventional displacement, velocity, acceleration, force, and pressure sensors. Pressure sensors include pressure transducers such as microphones. Certain applications, such as the evaluation of acoustic particle velocity through a pressure gradient measurement, require using two microphones having outputs which are accurately matched in amplitude and phase. Inexpensive microphones costing a few dollars do not have the amplitude and phase of their outputs accurately matched to each other, or to a reference microphone, due to manufacturing tolerances or design differences. Such inexpensive microphones are not suitable for precise measurement applications. It is known to use an expensive pair of matched microphones, costing several thousands of dollars, for precise applications. It is also known (U.S. Pat. No. 5,125,260) to use a computer to store measured phase and amplitude frequency responses of two unmatched microphones, to apply curve fits to such responses to extract phase and amplitude correction coefficients for each microphone, to store the amplitude and phase correction coefficients in an independent computer data base, and to later use such amplitude and phase correction coefficients to computationally compensate the unmatched microphone pair for phase and amplitude mismatch. Such known sensor output compensation technique requires using an expensive, calibrated reference microphone in calculating the amplitude and phase correction coefficients of the two unmatched microphones. What is needed is a relatively inexpensive technique to accurately match the outputs of unmatched sensors.

SUMMARY OF THE INVENTION

It is an object of the invention to provide a technique which uses source modeling and sensor output compensation to match the outputs of unmatched sensors.

The method of the invention is a method for matching the second output of a second sensor to the first output of a first sensor, wherein the first and second sensors sense the same physical quantity which can be produced by a source transducer driven by a reference electrical signal. The method includes steps a) through g). Step a) is the step of exposing the first sensor to the physical quantity produced by the source transducer driven by the reference electrical signal. Step b) is the step of presenting the first output of the first sensor as a sampled first digital output, and step c) is the step of presenting the reference electrical signal as a sampled reference digital output. Step d) is the step of numerically adaptively filtering the reference digital output with a reference filter having adaptive reference filtering coefficients until the reference filtering coefficients are determined such that the filtered reference digital output matches the first digital output to within a reference predetermined value. Step e) is the step of exposing the second sensor to the physical quantity generally identically to the exposing of the first sensor to the physical quantity in step a). Step f) is the step of presenting the second output of the second sensor as a sampled second digital output. Step g) is the step of numerically adaptively filtering the second digital output with a second filter having adaptive second filtering coefficients until the second filtering coefficients are determined such that the filtered second digital output matches the matched filtered reference digital output to within a second predetermined value.

Several benefits and advantages are derived from the invention. The second sensor may have its output compensated by the second filter to match the matched filtered reference digital output in step g) without the use of the first sensor once the adaptive reference filtering coefficients have been determined for the reference filter in step d). That is, step d) need only be performed once using, for example, an expensive, calibrated reference sensor as the first sensor. Thereafter, numerous inexpensive sensors (such as the second sensor) may have their outputs matched to the output of the first sensor without the first sensor being present!

BRIEF DESCRIPTION OF THE DRAWINGS

The accompanying drawings illustrate a preferred embodiment of the present invention wherein.

DETAILED DESCRIPTION OF THE INVENTION

Figure 1:
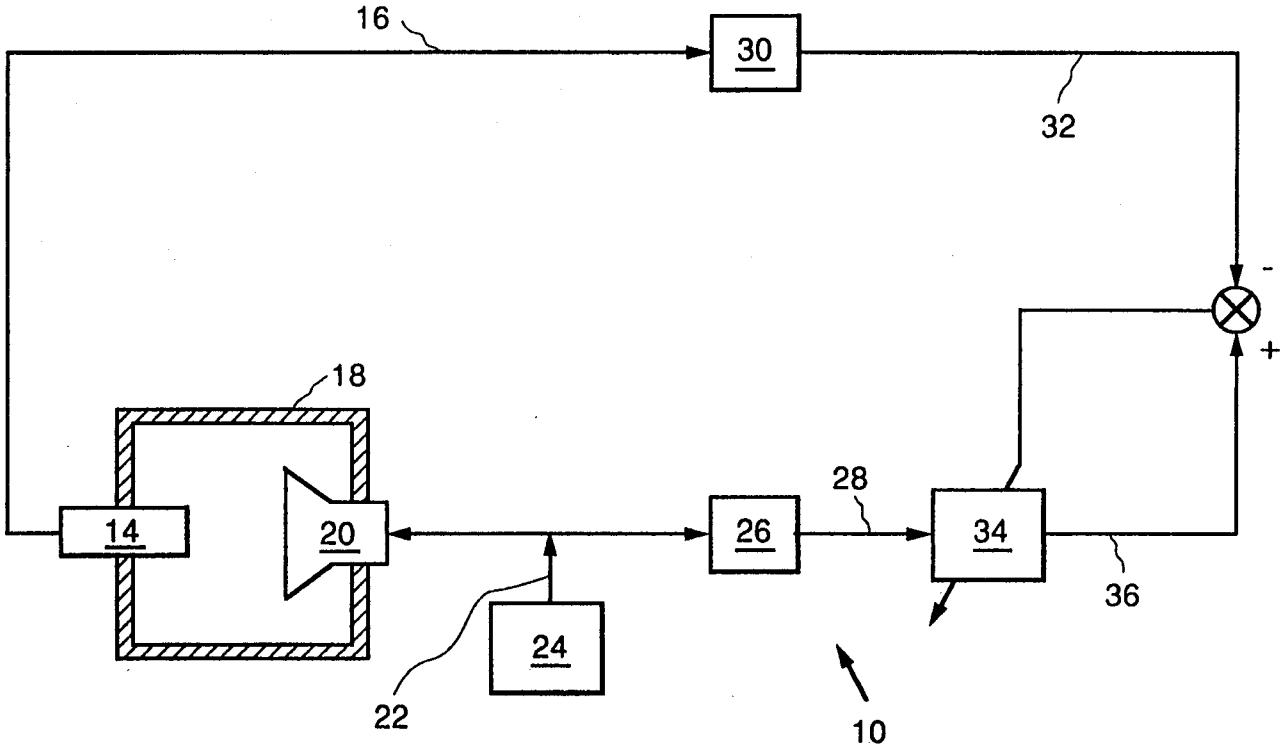
FIG. 1 is a schematic view of preferred apparatus used to adaptively determine reference filtering coefficients which will cause the output of a reference filter to match the output of a first sensor.
Figure 2:
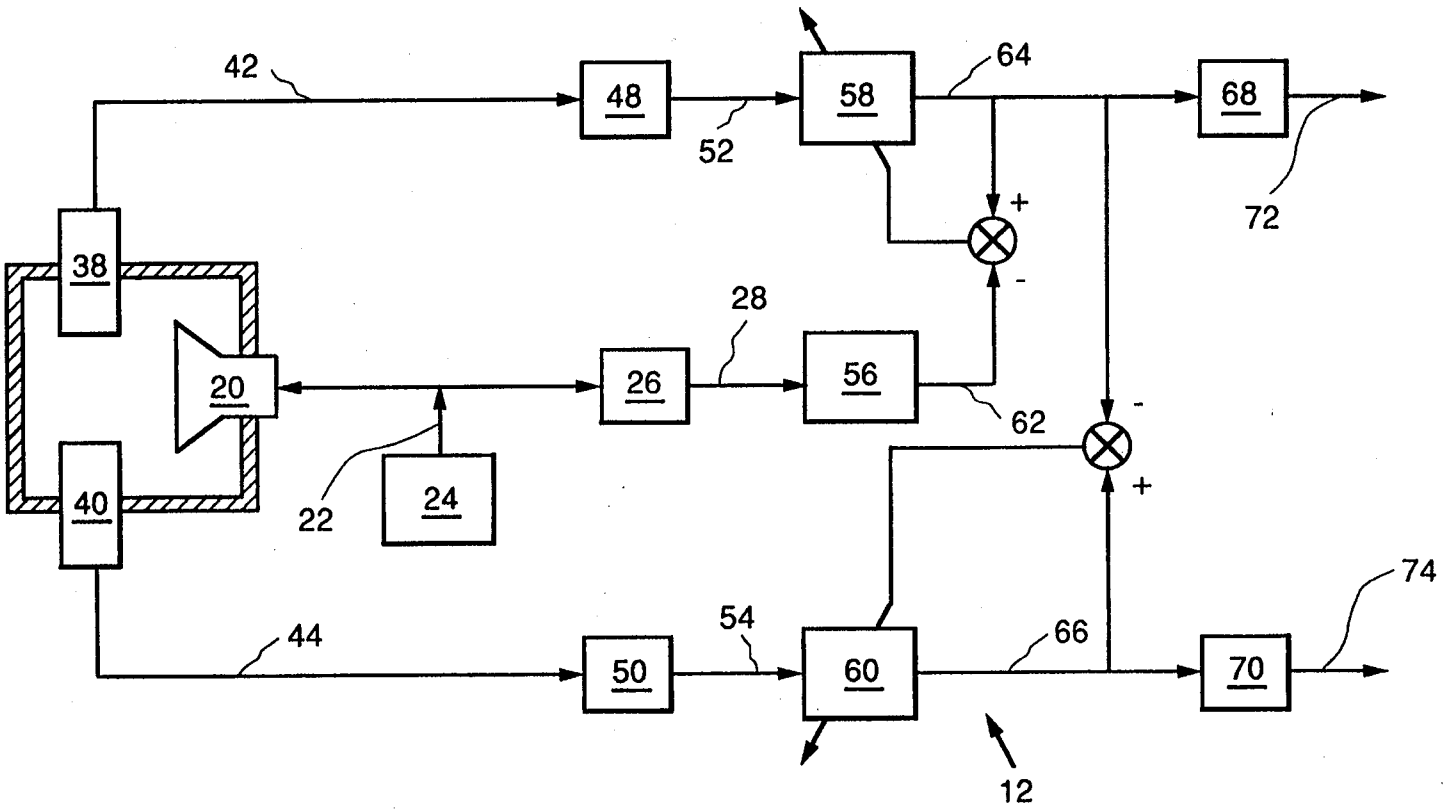
FIG. 2 is a schematic view of preferred apparatus used to match the output of a second and a third sensor to the output of the reference filter without the presence of the first sensor.

Referring now to the drawings, wherein like numerals represent like elements throughout, FIGS. 1 and 2 show preferred apparatus 10 and 12 used for the method of the invention.

Apparatus 10 includes a first sensor 14 which senses a physical quantity, which has a first output 16, and which is disposed (e.g., placed partially within a housing 18) such that it may be exposed to a source transducer 20. The source transducer 20 is driven by a reference electrical signal 22 from a signal generator 24 and can produce the physical quantity sensed by the first sensor 14. It is noted that reference electrical signal 22 can be any arbitrary electrical signal including, but not limited to, an analog or digital electrical signal which may be broadband, narrowband, or pure tone, etc. Preferably, the first sensor 14 is a reference sensor having an independently-calibrated amplitude and phase response. Preferably, the source transducer 20 is a loudspeaker, the first sensor 14 is a pressure transducer (such as a microphone), and the first output 16 is an analog output which is a first electrical signal. Other source transducers 20 include, but are not limited to, electrodynamic actuators, piezoelectric actuators, and lasers. Other first sensors 14 include, but are not limited to, velocity, force, and light sensors. It is noted that when the reference electrical signal 22 is digital, the loudspeaker (or other source transducer 20) would also include a digital-to-analog converter and, if desired by the artisan, a low-pass filter and an output amplifier.

If the reference electrical signal 22 is an analog electrical signal, apparatus 10 additionally includes a reference electrical-signal processor 26. The reference electrical-signal processor 26 comprises an analog-to-digital converter having an analog input side operatively connected to the reference electrical signal 22, having a sampling interval, and having a digital output side yielding a reference digital output 28 for each sampling interval to present the reference electrical signal 22 of the signal generator 24 as the reference digital output 28. In many applications, as can be appreciated by the artisan, the reference electrical-signal processor 26 may also comprise an amplifier followed by a low-pass filter operatively connected between the reference electrical signal 22 and the analog-to-digital converter for appropriate signal conditioning. If the first output 16 is an analog output, apparatus 10 also includes a first sensor-output processor 30, generally identical to the reference electrical-signal processor 26, for converting the first output 16 to a first digital output 32.

Apparatus 10 further includes a reference adaptive filter 34. The reference adaptive filter 34 has an input side operatively connected to the output side of the reference electrical-signal processor 26, has adaptive reference filtering coefficients, and has a filtered reference digital output 36 equal to the sum of the products of the reference digital outputs 28 and the associated reference filtering coefficients for numerically adaptively filtering the reference digital output 28 until the adaptive reference filtering coefficients are determined such that the filtered reference digital output 36 matches the first digital output 32 to within a reference predetermined value. Once this condition is satisfied, the adaptive reference filtering coefficients are said to be adaptively-determined and will be used in apparatus 12 to be hereinafter described.

Preferably, apparatus 12 includes the signal generator 24 producing the reference electrical signal 22 which drives the source transducer 20 and which is processed by the reference electrical-signal processor 26 as was used in apparatus 10. As can be appreciated by those skilled in the art, the source transducer used in apparatus 12 should be the exact same source transducer used in apparatus 10, and the signal generator, reference electrical signal, and reference electrical-signal processor used in apparatus 12 should be the same as, or generally identical to, those used in apparatus 10.

Apparatus 12 also includes second, and third unmatched sensors 38 and 40 which sense the same physical quantity sensed by the first sensor 14, which have corresponding second, and third outputs 42 and 44, and which are disposed (e.g., placed partially within a housing which is generally identical to housing 18) such that they may be exposed to the source transducer 20 in a manner generally identical to the manner the first sensor 14 is exposed to the source transducer 20 in apparatus 10. Preferably, the third sensor 40 is generally identical to the second sensor 38 to within predetermined manufacturing tolerances. Preferably, the second and third outputs 42 and 44 are analog outputs which are corresponding second and third electrical signals.

If the outputs 42 and 44 are analog outputs, apparatus 12 additionally includes second and third sensor-output processors 48 and 50, generally identical to the reference electrical-signal processor 26 of apparatus 10 shown in FIG. 1, for converting the second and third outputs 42 and 44 to corresponding second and third digital outputs 52 and 54, as shown in FIG. 2.

Apparatus 12 further includes a reference fixed filter 56, a second adaptive filter 58 and a third adaptive filter 60 which are generally identical to the reference adaptive filter but with their own filtering coefficients. The reference fixed filter 56 has fixed (i.e., non-adaptive) reference filtering coefficients equal to the determined (i.e., adaptively-determined) reference filtering coefficients of the reference adaptive filter 34 of apparatus 10 shown in FIG. 1. The second and third adaptive filters 58 and 60 have corresponding second and third adaptive filtering coefficients. It is noted that the artisan may choose a different predetermined number of sampling intervals for the adaptive or fixed filtering for each filter 34, 56, 58, and 60.

The fixed filter 56 has an input side operatively connected to the output side of the reference electrical-signal processor 26 in FIG. 2 and has a matched filtered reference digital output 62 equal to the sum of the products of the reference digital outputs 28 and the associated fixed reference filtering coefficients.

The second adaptive filter 58 has an input side operatively connected to the output side of the second sensor-output processor 48 and has a filtered second digital output 64 equal to the sum of the products of the second digital outputs 52 and the associated second filtering coefficients for numerically adaptively filtering the second digital output 52 until the adaptive second filtering coefficients are determined such that the filtered second digital output 64 matches the matched filtered reference digital output 62 to within a second predetermined value. Once this condition is satisfied, or during such times as this condition is satisfied, apparatus 12 can be further used with the second adaptive filter 58 utilizing the determined (i.e., adaptively-determined) second filtering coefficients (i.e., the values of the adaptive second filtering coefficients-which allow the filtered second digital output 64 to match the matched filtered reference digital output 62) for a fixed, non-adaptive mode of filtering.

The third adaptive filter 60 has an input side operatively connected to the output side of the third sensor-output processor 50 and has a filtered third digital output 66 equal to the sum of the products of the third digital outputs 54 and the associated third filtering coefficients for numerically adaptively filtering the third digital output 54 until the adaptive third filtering coefficients are determined such that the filtered third digital output 66 matches the filtered second digital output 64 to within a third predetermined value. Once this condition is satisfied, or during such times as this condition is satisfied, apparatus 12 can be further used with the third adaptive filter 60 utilizing the determined (i.e., adaptively-determined) third filtering coefficients (i.e., the values of the adaptive third filtering coefficients which allow the filtered third digital output 66 to match the filtered second digital output 64) for a fixed, non-adaptive mode of filtering.

As can be appreciated by one skilled in the art, apparatus 10 (shown in FIG. 1) may include a time delay to make sure that the time information takes to travel from the signal generator 24 through the first sensor-output processor 30 (via the source transducer 20 and the first sensor 14) is greater than or equal to the time information takes to travel from the signal generator 24 through the-reference electrical-signal processor 26. This insures that the system of apparatus 10 is causal, as can be appreciated by those skilled in the art. For example, the first sensor-output processor 30 may include a time delay following its analog-to-digital converter to delay the first digital output 32, or the first sensor 14 may be disposed slightly further away from the source transducer 20. Likewise, apparatus 12 (shown in FIG. 2) may include a time delay to make sure that the time information takes to travel from the signal generator 24 through the reference fixed filter 56 (via the reference electrical-signal processor 26) is greater than or equal to the time information takes to travel from the signal generator 24 through the second sensor-output processor 48 (via the source transducer 20 and the second sensor 38), and that the time information takes to travel from the signal generator 24 through the reference fixed filter 56 (via the reference electrical-signal processor 26) is greater than or equal to the time information takes to travel from the signal generator 24 through the third sensor-output processor 50 (via the source transducer 20 and the third sensor 40).

It is noted that the filtered (compensated) second and third digital outputs 64 and 66 may be used as inputs to a digital computer or other digital device. Alternately, apparatus 12 may be provided with second and third filter-output processors 68 and 70 (each comprising a digital-to-analog converter and, if desired by the artisan, a low-pass filter and an output amplifier) if filtered (compensated) second and third analog outputs 72 and 74 are desired.

A first preferred method of the invention is for matching the second output 42 of the second sensor 38 to the first output 16 of the first sensor 14, wherein (as previously mentioned) the first and second sensors 14 and 38 sense the same physical quantity (e.g., acoustic pressure) and wherein the physical quantity can be produced by the source transducer 20 driven by the reference electrical signal 22. The method comprises steps a) through g). Step a) comprises exposing the first sensor 14 to the physical quantity produced by the source transducer 20 driven by the reference electrical signal 22. Step b) comprises presenting the first output 16 of the first sensor 14 as a sampled first digital output 32, and step c) comprises presenting the reference electrical signal 22 as a sampled reference digital output 28. Step d) comprises numerically adaptively filtering the reference digital output 28 with a reference filter 34 having adaptive reference filtering coefficients until the reference filtering coefficients are determined such that the filtered reference digital output 36 matches the first digital output 32 to within a reference predetermined value. Step e) comprises exposing the second sensor 38 to the physical quantity generally identically to the exposing of the first sensor 14 to the physical quantity in step a), and step f) comprises presenting the second output 42 of the second sensor 38 as a sampled second digital output 52. Step g) comprises numerically adaptively filtering the second digital output 52 with a second filter 58 having adaptive second filtering coefficients until the second filtering coefficients are determined such that the filtered second digital output 64 matches the matched filtered reference digital output 62 to within a second predetermined value.

A second preferred method of the invention is for also matching the third output 44 of the third sensor 40 to the second output 42 of the second sensor 38, wherein the third sensor 40 is generally identical to the second sensor 38 to within predetermined manufacturing tolerances. The method also comprises steps h) through j). Step h) comprises exposing the third sensor 40 to the physical quantity generally identically and simultaneously to the exposing of the second sensor 38 to the physical quantity in step e). Step i) comprises presenting the third output 44 of the third sensor 40 as a sampled third digital output 54. Step j) comprises numerically adaptively filtering the third digital output 54 with a third filter 60 having adaptive third filtering coefficients until the third filtering coefficients are determined such that the filtered third digital output 66 matches the filtered second digital output 64 to within a third predetermined value. It is noted that the third adaptive filter 60 compares the filtered third digital output 66 with the filtered second digital output 64 (instead of with the matched filtered reference digital output 62) which in practice may more accurately match the phase response of the third sensor 40 to the phase response of the second sensor 38.

Preferably, the first, second, and third sensors 14, 38, and 40 comprise pressure transducers (such as microphones); the first, second, and third outputs 16, 42, and 44 comprise first, second, and third analog outputs; and the first, second, and third analog outputs comprise first, second, and third electrical signals. In an exemplary method, step b) comprises converting the first electrical signal to the first digital output 32, step f) comprises converting the second electrical signal to the second digital output 52, and step i) comprises converting the third electrical signal to the third digital output 54.

In an exemplary method, the reference electrical signal 22 driving the source transducer 20 is a broadband, generally stationary, analog reference electrical signal, and step c) comprises converting the analog reference electrical signal to the reference digital output 28.

Preferably, the method also includes the step of numerically filtering the second digital output 52 using the determined second filtering coefficients when the filtered second digital output 64 matches the matched filtered reference digital output 62 to within the second predetermined value, and also includes the step of numerically filtering the third digital output 54 using the determined third filtering coefficients when the filtered third digital output 66 matches the filtered second digital output 64 to within the third predetermined value.

In an exemplary method, steps e) through j) of the method are performed generally simultaneously, steps a) through d) of the method are performed generally simultaneously, and steps e) through j) of the method are performed after steps a) through d) of the method are performed. Thus, an independently-calibrated sensor may be used as the first sensor 14 in apparatus 10 and used only once. Thereafter, an unlimited number of unmatched sensors (such as second sensor 38) may be matched to the matched filtered reference digital output 62 of the reference fixed filter 56 without the presence of the expensive, independently-calibrated sensor. Also, thereafter, an unlimited number of unmatched sensor pairs (such as second sensor 38 and third sensor 40) may have one of the pair matched to the other of the pair and have the other of the pair matched to the matched filtered reference digital output 62 without the presence of the expensive, independently-calibrated sensor. It is noted that the reference fixed filter 56 may be considered a source model (since it models the source transducer 20) as well as a first sensor model (since it models the first sensor 14 which typically would be an expensive, independently-calibrated sensor). It is further noted that the filtering of the second and third digital outputs 52 and 54 by the second and third adaptive filters 58 and 60 may be considered as compensating the outputs 42 and 44 of the second and third sensors 38 and 40 to respectively match the filtered second digital output 64 of the second sensor 38 to the first digital output 16 of the first sensor 14 and to match the filtered third digital output 66 of the third sensor 40 to the filtered second digital output 64 of the second sensor 38.

Known digital signal processors (such as a Motorola DSP56000 digital signal processor costing ten dollars or so) may be programed for adaptive filtering to become the reference, second, and third adaptive filters 34, 58, and 60 and may be programed for fixed filtering to become the reference fixed filter 56, as is within the skill of the artisan. For example, the reference adaptive filter 34 of apparatus 10 in FIG. 1 can be programmed such that:

$$Y(k)=X(k)W(0)+X(k-1)W(1)+\ldots+X(k-n)W(n)$$

where n is a predetermined number of sampling intervals chosen by the artisan for the adaptive filtering, k is the present sample interval, k−1 is the first previous sample interval, k−n is the nth previous sample interval, Y(k) is the filtered reference digital output 36 for the present sample interval, X(k) is the reference digital output 28 for the present sample interval, and W(n) is the adaptive filtering coefficient associated with the reference digital output 28 for the (k−n)th previous sample interval. One known technique for updating the adaptive filtering coefficients is:

$$updated\ W(0)=old\ W(0)+2cE(k)X(k),$$

$$updated\ W(1)=old\ W(1)+2cE(k)X(k-1),$$

$$updated\ W(n)=old\ W(n)+2cE(k)X(k-n)$$

where E(k) is the difference between Z(k) and Y(k), Z(k) is the first digital output 32 for the present sample interval, and c is a convergence constant that affects the algorithm adaptation speed and is chosen by the artisan. Once the adaptive filtering coefficients have converged such that Y(k) and Z(k) are equal to within the reference predetermined value, the adaptive filtering coefficients W(0), W(1), . . . , W(n) are no longer updated. The adaptive filtering coefficients are then said to be determined and are fixed in value and would be used as the fixed filtering coefficients of the reference fixed filter 56 of apparatus 12 in FIG. 2.

It is noted that for the reference electrical-signal processor 26 and the second and third sensor-output processors 48 and 50, the use of variable-gain or auto-ranging input amplifiers will ensure good matching of the input levels with the dynamic range of the analog-to-digital converters, resulting in optimum performance. Also critical to system performance are high-accuracy analog-to-digital and digital-to-analog converters. Converters having at least 16-bit accumulators are recommended. System performance is limited mainly by the 16-bit resolution of the converters rather than by the computational noise of the filtering because the relatively low-cost fractional digital signal processors (such as the Motorola DSP56000) have 40-bit or better accumulators. Therefore, the use of slightly higher cost, more accurate floating-point digital signal processors may not be warranted.

The foregoing description of a preferred embodiment of the invention has been presented for purposes of illustration. It is not intended to be exhaustive or to limit the invention to the precise form disclosed, and obviously many modifications and variations are possible in light of the above teaching. For example, the sensors are not limited to microphones or other pressure transducers, an analog-to-digital converter having multiple inputs and outputs is equivalent to separate analog-to-digital converters each having one input and one output, inputs to analog-to-digital converters may be multiplexed to reduce the number of analog-to-digital converters, and more than two sensors may be matched to a reference sensor. It is intended that the scope of the invention be defined by the claims appended hereto.

We claim:

1. A method for matching the second output of a second sensor to the first output of a first sensor, wherein said first and second sensors sense the same physical quantity, wherein said physical quantity can be produced by a source transducer driven by a reference electrical signal, and wherein said method comprises the steps of:

a) exposing said first sensor to said physical quantity produced by said source transducer driven by said reference electrical signal;

b) presenting said first output of said first sensor as a sampled first digital output;

c) presenting said reference electrical signal as a sampled reference digital output;

d) numerically adaptively filtering said reference digital output with a reference filter having adaptive reference filtering coefficients until said reference filtering coefficients are determined such that said filtered reference digital output matches said first digital output to within a reference predetermined value;

e) exposing said second sensor to said physical quantity generally identically to said exposing of said first sensor to said physical quantity in step a);

f) presenting said second output of said second sensor as a sampled second digital output; and g) numerically adaptively filtering said second digital output with a second filter having adaptive second filtering coefficients until said second filtering coefficients are determined such that said filtered second digital output matches said matched filtered reference digital output to within a second predetermined value.

2. The method of claim 1, wherein said first and second sensors comprise pressure transducers, said first and second outputs comprise first and second analog outputs, said first and second analog outputs comprise first and second electrical signals, step b) comprises converting said first electrical signal to said first digital output, and step f) comprises converting said second electrical signal to said second digital output.

3. The method of claim 2, also including the step of numerically filtering said second digital output using said determined second filtering coefficients when said filtered second digital output matches said matched filtered reference digital output to within said second predetermined value.

4. The method of claim 3, wherein steps e) through g) of said method are performed generally simultaneously, steps a) through d) of said method are performed generally simultaneously, and steps e) through g) of said method are performed after steps a) through d) of said method are performed.

5. The method of claim 4, wherein said reference electrical signal driving said source transducer is a broadband, generally stationary, analog reference electrical signal, and wherein step c) comprises converting said analog reference electrical signal into said reference digital output.

6. The method of claim 1 for also matching the third output of a third sensor to said second output of said second sensor, wherein said third sensor is generally identical to said second sensor to within predetermined manufacturing tolerances, and wherein said method also comprises the steps of:

h) exposing said third sensor to said physical quantity generally identically and simultaneously to said exposing of said second sensor to said physical quantity in step e);

i) presenting said third output of said third sensor as a sampled third digital output; and j) numerically adaptively filtering said third digital output with a third filter having adaptive third filtering coefficients until said third filtering coefficients are determined such that said filtered third digital output matches said filtered second digital output to within a third predetermined value.

7. The method of claim 6, wherein: said first, second, and third sensors comprise pressure transducers; said first, second, and third outputs comprise first, second, and third analog outputs; said first, second, and third analog outputs comprise first, second, and third electrical signals; step b) comprises converting said first electrical signal to said first digital output; step f) comprises converting said second electrical signal to said second digital output; and step i) comprises converting said third electrical signal to said third digital output.

8. The method of claim 7, also including the step of numerically filtering said second digital output using said determined second filtering coefficients when said filtered second digital output matches said matched filtered reference digital output to within said second predetermined value, and also including the step of numerically filtering said third digital output using said determined third filtering coefficients when said filtered third digital output matches said filtered second digital output to within said third predetermined value.

9. The method of claim 8, wherein steps e) through j) of said method are performed generally simultaneously, steps a) through d) of said method are performed generally simultaneously, and steps e) through j) of said method are performed after steps a) through d) of said method are performed.

10. The method of claim 9, wherein said reference electrical signal driving said source transducer is a broadband, generally stationary, analog reference electrical signal, and wherein step c) comprises converting said analog reference electrical signal into said reference digital output.

* * * * *